US006430932B1

(12) United States Patent
Martling et al.

(10) Patent No.: US 6,430,932 B1
(45) Date of Patent: Aug. 13, 2002

(54) LOW NOX COMBUSTION LINER WITH COOLING AIR PLENUM RECESSES

(75) Inventors: Vincent C. Martling, West Palm Beach; Brian R. Mack; Robert J. Kraft, both of Palm City; Mark A. Minnich, Jupiter, all of FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 09/909,029

(22) Filed: Jul. 19, 2001

(51) Int. Cl.[7] ..... F02G 3/00
(52) U.S. Cl. ..... 60/760; 60/798
(58) Field of Search ..... 60/752, 760, 798

(56) References Cited

U.S. PATENT DOCUMENTS

| | | | | |
|---|---|---|---|---|
| 2,692,478 A | * | 10/1954 | Hill | 60/752 |
| 4,292,801 A | | 10/1981 | Wilkes et al. | |
| 4,982,570 A | | 1/1991 | Weslo et al. | |
| 4,984,429 A | | 1/1991 | Waslo et al. | |
| 5,117,636 A | | 6/1992 | Bechtel, II et al. | |
| 5,181,379 A | | 1/1993 | Wakeman et al. | |
| 5,233,828 A | | 8/1993 | Napoli | |
| 5,261,223 A | | 11/1993 | Foltz | |
| 5,279,127 A | | 1/1994 | Napoli | |
| 5,282,631 A | | 2/1994 | Bechtell, II et al. | |
| 5,307,637 A | | 5/1994 | Stickles et al. | |
| 5,454,221 A | | 10/1995 | Loprinzo | |
| 5,575,154 A | | 11/1996 | Loprinzo | |

* cited by examiner

*Primary Examiner*—Ehud Gartenberg
(74) *Attorney, Agent, or Firm*—Brian R. Mack

(57) ABSTRACT

A combustion liner assembly for reducing nitric oxide (NOx) emissions is disclosed. This combustion liner utilizes an annular plenum outside the liner shell for the purpose of containing cooling air that has been heated and reintroducing it into the combustion process. The air plenum can be enlarged to increase the amount of cooling air contained within and still allow for installation of the liner assembly into the combustor by utilizing recesses that locally reduce the diameter of the air plenum to allow it to pass by liner mounting pegs within the combustor assembly.

7 Claims, 5 Drawing Sheets

LOW NOX COMBUSTION LINER WITH COOLING AIR PLENUM RECESSES

BACKGROUND OF THE INVENTION

1. Field of the Invention

This invention relates to gas turbine engines, and more specifically to an apparatus for reducing nitric oxide (NOx) emissions and cooling the combustion liner for a can-annular gas turbine combustion system.

2. Description of Related Art

Combustion liners are commonly used within the combustion section for most gas turbine engines. They serve to protect the combustor casing and surrounding engine from the extremely high operating temperatures by containing the chemical reaction that occurs between the fuel and air.

Recently, government emission regulations have become of great concern to both gas turbine manufacturers and operators. Of specific concern is emission of nitric oxide (NOx) and its contribution to air pollution, since utility sites have governmental permits that restrict allowable amounts of NOx emissions per year. It is therefore desirable to have engines with lower emission rates, especially NOx, since these engines are allowed to run longer hours and, as a result, generate more revenue for their operators.

It is well known that NOx formation is a function of flame temperature, air inlet temperature, residence time, and fuel/air ratio. Lower flame temperature, shorter residence time, and lower fuel/air ratio have all been found to lower NOx emissions. Lower flame temperature and lower fuel/air ratios can be achieved by increasing the amount of air introduced in the combustion process, for a given amount of fuel.

However, due to the high operating temperatures of gas turbines, a significant portion of the air exiting the engine's compressor is needed to cool the engine parts to prevent their premature failure. Since much of the air used for cooling such parts bypasses the combustor, increases in cooling air demands reduce the air available for combustion, thereby increasing the fuel/air ratio for a given fuel flow, resulting in a higher flame temperature that tends to exacerbate NOx emission problems.

What is needed is an apparatus that maximizes the use of available air for combustion by using the air originally dedicated only for cooling to lower the combustor's fuel/air ratio, and in turn, lowering NOx emissions.

SUMMARY AND OBJECTS OF THE INVENTION

It is therefore an object of the present invention to provide a means to increase the amount of air to the combustion zone of a dual stage dual mode combustion liner.

It is a further object of the present invention to provide an aid for assembly and disassembly of the combustion liner to the combustion system.

According to the present invention a combustion liner intended for use in a dry, low NOx gas turbine engine, of the type typically used to drive electrical generators is disclosed. The combustion liner includes an upstream premix fuel/air chamber and a downstream, or secondary, combustion chamber, separated by a venturi having a narrow throat constriction. A plenum is utilized to direct cooling air from the venturi into the premix chamber, which in turn, reduces the level of NOx emissions. Depending on the size of the combustion liner and its mating hardware, typically a flow sleeve or heatshield, the size of the air plenum, and hence the amount of air that can be introduced into the premix chamber, is limited. The invention disclosed in this application helps to overcome this limitation by introducing a structural insert, or recess, to the air plenum that aids in assembly of the combustion liner to the mating hardware, when the air plenum is oversized.

In accordance with these and other objects, which will become apparent hereinafter, the instant invention will now be described with particular reference to the accompanying drawings.

DETAILED DESCRIPTION OF THE PREFERRED EMBODIMENT

Figure 1:
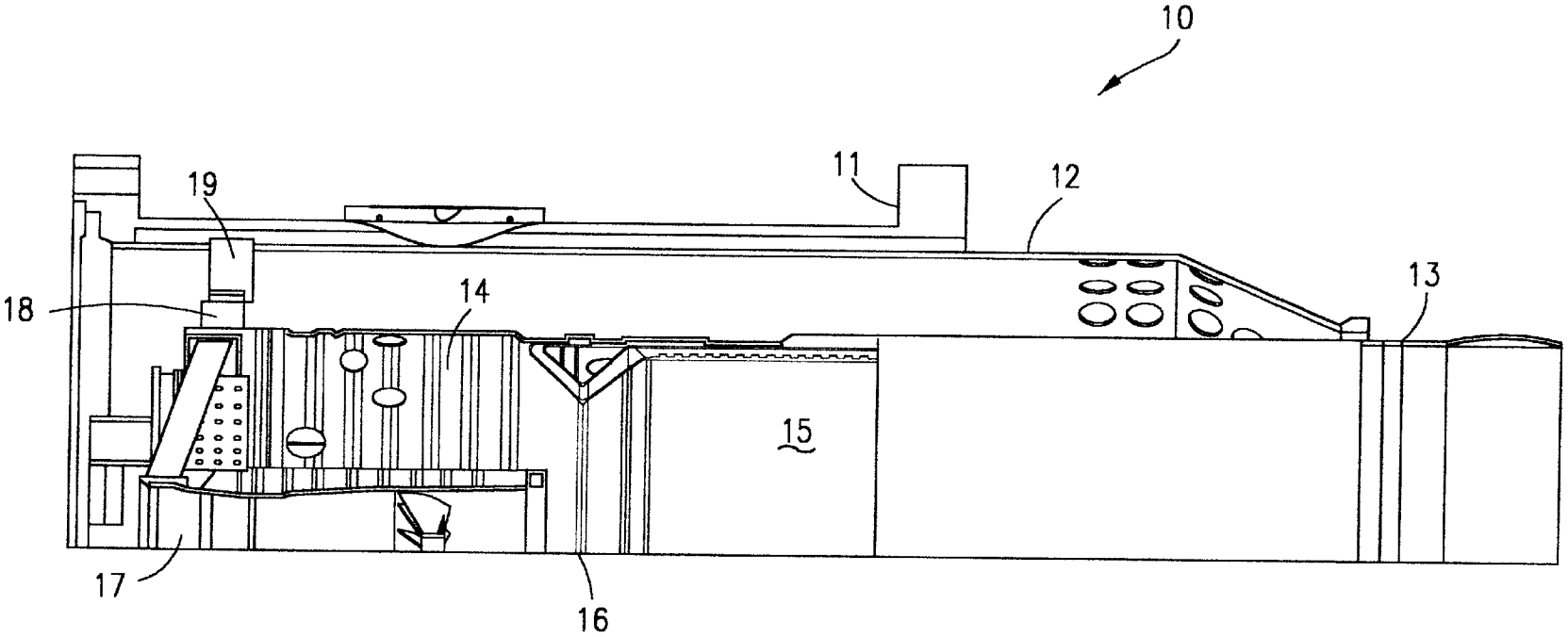
FIG. 1 PRIOR ART
FIG. 1 is a side elevation, in cross section, of a portion of a typical industrial gas turbine combustor.

Referring to FIG. 1, a typical combustor 10 is shown. The combustor includes an outer casing 11, heatshield or flow sleeve 12, and combustion liner 13. The fuel system components have been removed for clarity. Combustion liner 13 includes two combustion chambers 14 and 15, separated by a venturi 16. Also included in combustion liner 13 is a cap assembly 17, which is used to position various fuel nozzles (not shown). Combustion liner 13 is held within sleeve 12 by a set of tabs 18, which are fixed to liner 13, and a set of pegs 19 which are fixed to sleeve 12. During installation of the combustion liner, tabs 18 slide within pegs 19 and hold combustion liner 13 in place within combustor 10.

Figure 2:
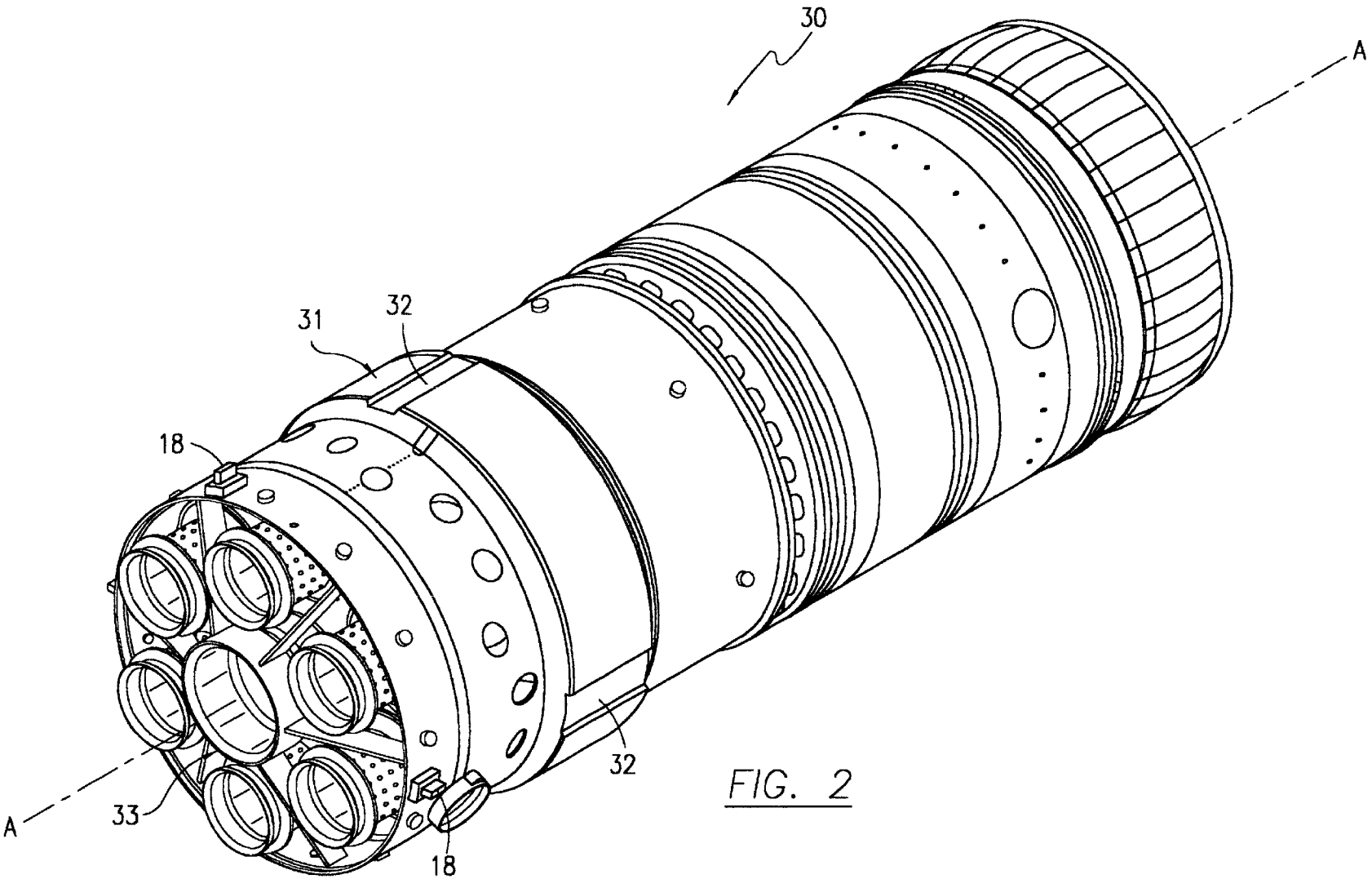
FIG. 2 As an isometric view of an improved combustion liner utilizing the present invention.

Referring now to FIG. 2, a perspective view of an alternate combustion liner 30, which incorporates the present invention, is shown. This combustion liner includes an air plenum 31 for introducing pre-heated cooling air into the upstream combustion chamber. This combustion liner also includes a set of tabs 18, cap assembly 33, and a venturi separating the upstream and downstream combustion chambers (not shown in FIG. 2). Air plenum 31 also includes multiple recesses 32, which are inset at a reduced diameter compared to air plenum 31 relative to combustion liner axis A—A. The air plenum and cooling circuit is shown in more detail in FIG. 3, which is a cross section of combustion liner 30.

Figure 3:
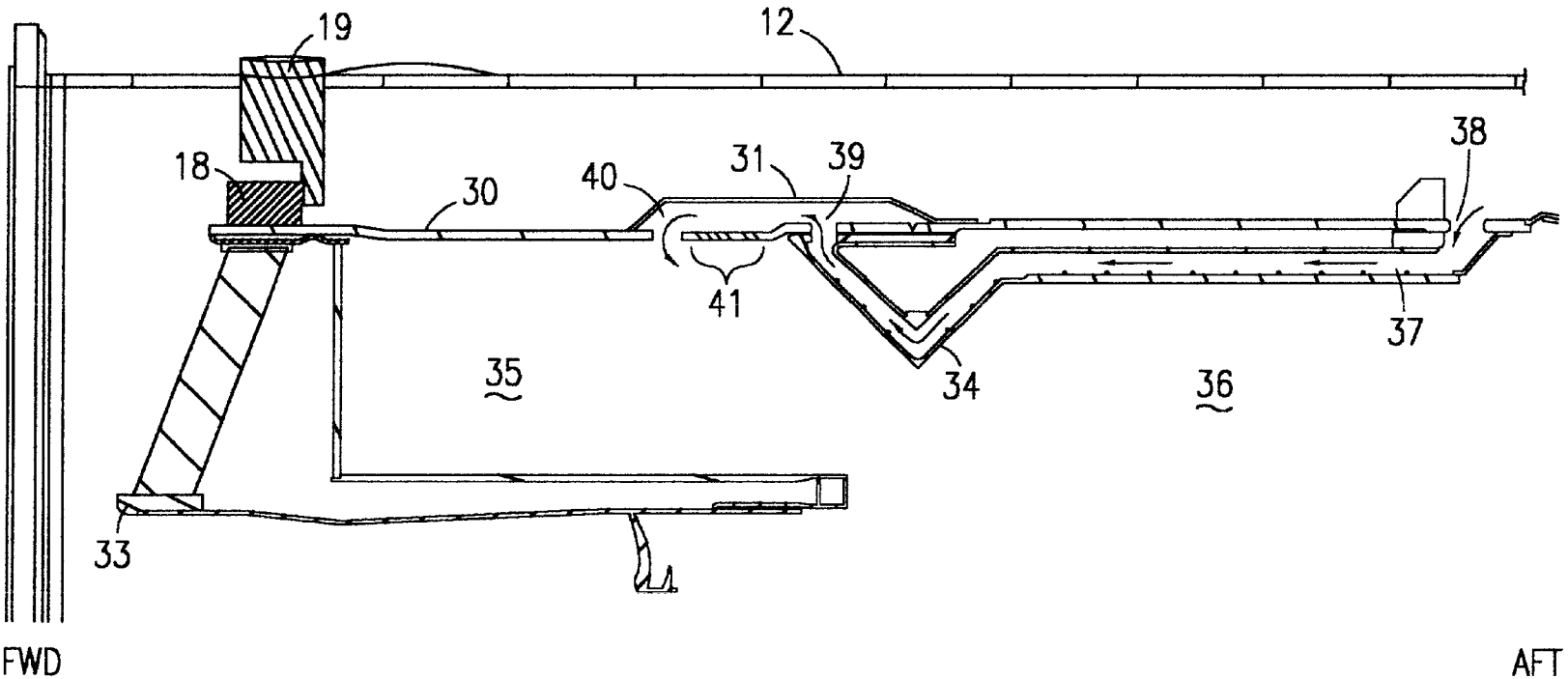
FIG. 3 is a side elevation, in cross section, of a portion of a combustor in which the present invention is utilized.

FIG. 3 shows a detailed cross section of combustion liner 30 installed within flow sleeve 12. Combustion liner 30 has a set of tabs 18 fixed to it, which slide into a corresponding set of pegs 19, which are fixed to flow sleeve 12, when the combustion liner is installed in said flow sleeve. Also shown in this figure is the cap assembly 33 and venturi 34, which separates the upstream and downstream combustion chambers, 35 and 36, respectively. As discussed in co-pending U.S. patent application Ser. Nos. 09/664,898 and 09/605,765, assigned to the same assignee as the present invention, cooling air enters the double walled venturi cooling channel 37 through apertures 38 and travels forward, as indicated by the arrows, and exits the venturi through exit apertures 39 to flow into air plenum 31. This air is then introduced to the combustion mixing process in the upstream chamber 35 through plenum apertures 40 and 41. As discussed in the references, this additional cooling air mixed into the combustion process lowers the flame temperature and reduces the fuel to air ratio of the mixture, which results in lower NOx emissions.

The diameter of air plenum 31 is limited by obstacles, such as the flow sleeve pegs 19, in flow sleeve 12. The present invention helps to overcome these assembly obstacles by providing recesses 32 (as shown in FIG. 2) in the plenum such that the combustion liner 30 with air plenum 31 can slide past the flow sleeve pegs 19, and fit into position in the combustor.

Figure 4:
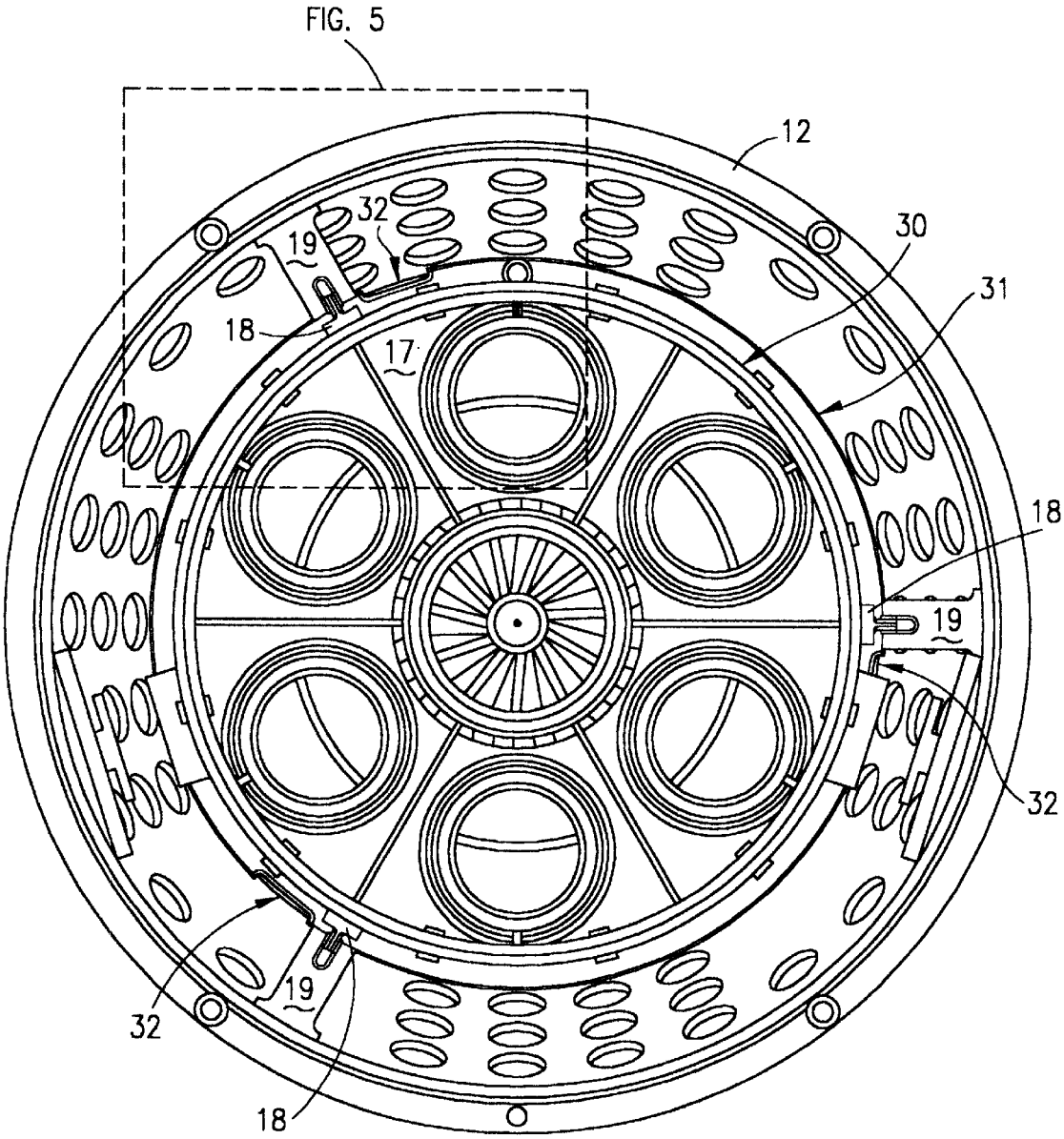
FIG. 4 is a front elevation, in cross section, of a portion of a combustor in which the present invention is utilized.

FIG. 4 shows a front view of the combustion liner 30 installed in flow sleeve 12, where tabs 18 are located within pegs 19. It can be seen from this figure that the air plenum 31 has a greater diameter than the flow sleeve pegs 19. In order to install combustion liner 30 in flow sleeve 12 without shortening pegs 19, recesses 32 are incorporated in air plenum 31. This allows the combustion liner to be a common component interchangeable with a variety of flow sleeves 12 while not compromising the structural integrity of the support system between the liner tabs 18 and flow sleeve pegs 19.

Figure 5:
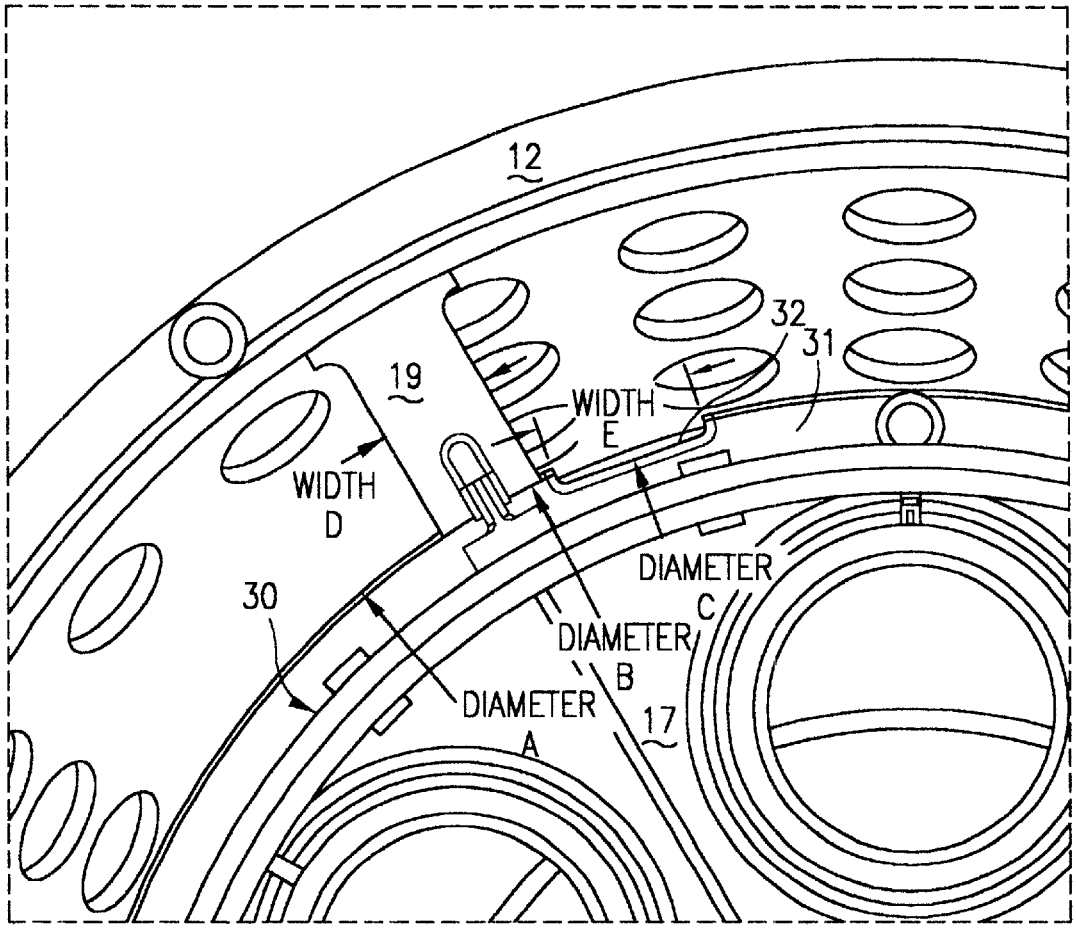
FIG. 5 is an enlarged view of FIG. 4, in a front elevation and cross section showing the present invention.

An enlarged view of this installation interference is shown in FIG. 5. The inclusion of air plenum recesses 32 on this type of combustion liner allows additional air to flow through the plenum 31 for use in the combustion process. Diameter A of air plenum 31, as measured from axis A—A, is larger than the radially inner diameter B of flow sleeve pegs 19, thereby preventing portions of the plenum from sliding past the flow sleeve pegs 19. However, the use of a recess 32 permits the liner 30 to be installed in the flow sleeve 12 despite the radial length of flow sleeve pegs 19. The recess 32 is sized such that diameter C is less than diameter B and width E is greater than width D to allow adequate clearance for the air plenum 31, and hence combustion liner 30, to pass axially by flow sleeve pegs 19 when each of the flow sleeve pegs 19 are radially aligned with one of the recesses 32. The recesses 32 are located circumferentially about the plenum 31 such that when the liner 30 is being installed in the flow sleeve 12, it can be rotated to a certain position at which each of the flow sleeve pegs 19 is axially aligned with one of the recesses 32, thereby allowing the liner to slide axially within the flow sleeve 12 without any interference between the plenum 31 and the flow sleeve pegs 19. Once the flow sleeve pegs 19 have cleared the plenum 31, the diameter of the liner 30, which is significantly less than diameter B, permits the liner 30 to be rotated to align the liner tabs 18 with the flow sleeve pegs 19 for insertion therebetween.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A combustion liner assembly for use with industrial gas turbine engines comprising:

a substantially cylindrical outer shell having a shell inlet end and a shell exit end, and a longitudinal axis defined therethrough, a premixing chamber for mixing fuel and air located adjacent said shell inlet end, a combustion chamber located between said premixing chamber and said exit end and in communication therewith, a plurality of tabs located near said shell inlet end for positioning said shell within a combustor, and a plurality of holes spaced around the circumference of said shell for introducing air into said shell;

a cap assembly positioned within said shell inlet end for regulating the amount of air introduced into said premixing chamber, said cap assembly having receptacles for a plurality of fuel nozzles;

a venturi assembly containing a cooling channel with at least one venturi inlet aperture for permitting cooling air to enter said venturi, and at least one venturi exit aperture for permitting cooling air to exit said venturi;

a plenum having a radially outer surface, relative to said axis, of larger diameter than said outer shell and fixed to said outer shell at a first location between said shell inlet end and said plurality of holes and at a second location between said at least one venturi exit aperture and said shell exit end for directing cooling air exiting said at least one venturi exit aperture into said plurality of holes; and, a plurality of recesses located along the radially outer surface of said plenum.

2. The combustion liner of claim 1 where in said recesses extend the full axial length of said plenum.

3. The combustion liner of claim 2 where in each of said combustion liner tabs is axially aligned with one of said recesses.

4. The combustion liner of claim 2 in which said recesses are circumferentially offset from said combustion liner tabs.

5. The combustion liner of claim 2 in which said air plenum and recesses are fabricated from material similar to that of said outer shell.

6. The combustion liner of claim 2 in which said air plenum extends radially outward from said outer shell a distance equal to the radially outer most surface of said combustion liner tabs.

7. The combustion liner of claim 2 in which said air plenum is generally trapezoidal in cross section.

* * * * *